US009412534B2

(12) United States Patent
Baumann

(10) Patent No.: US 9,412,534 B2
(45) Date of Patent: Aug. 9, 2016

(54) PUSHBUTTON COMPACT COMPONENT

(71) Applicant: Siemens Aktiengesellschaft, Munich (DE)

(72) Inventor: Michael Baumann, Schmidgaden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/409,274

(22) PCT Filed: Jul. 18, 2013

(86) PCT No.: PCT/EP2013/065216

§ 371 (c)(1),
(2) Date: Dec. 18, 2014

(87) PCT Pub. No.: WO2014/048602

PCT Pub. Date: Apr. 3, 2014

(65) Prior Publication Data

US 2015/0170852 A1 Jun. 18, 2015

(30) Foreign Application Priority Data

Sep. 26, 2012 (EP) ..... 12186105

(51) Int. Cl.

| | |
|---|---|
| ***H01H 13/14*** | (2006.01) |
| ***H01H 3/02*** | (2006.01) |
| ***H01H 9/16*** | (2006.01) |
| ***H01H 13/04*** | (2006.01) |
| ***H01H 13/52*** | (2006.01) |
| ***H01H 13/62*** | (2006.01) |

(52) U.S. Cl.

CPC ..... *H01H 13/14* (2013.01); *H01H 3/022* (2013.01); *H01H 9/16* (2013.01); *H01H 13/04* (2013.01); *H01H 13/52* (2013.01); *H01H 13/62* (2013.01); *H01H 2221/024* (2013.01);

(Continued)

(58) Field of Classification Search

CPC ..... H01H 3/022; H01H 9/16; H01H 13/04; H01H 2235/004; H01H 2239/03; H01H 2221/024; H01H 13/62; H01H 13/52; H01H 13/14; H01H 2221/044

USPC ..... 200/43.13

See application file for complete search history.

(56) References Cited

U.S. PATENT DOCUMENTS

| | | | |
|---|---|---|---|
| 4,431,881 | A | 2/1984 | Sauer et al. |
| 4,703,141 | A | 10/1987 | Grunst |

(Continued)

FOREIGN PATENT DOCUMENTS

| | | | |
|---|---|---|---|
| DE | 3533891 | A1 | 7/1986 |
| EP | 0032685 | A1 | 7/1981 |

(Continued)

OTHER PUBLICATIONS

International Search Report PCT/ISA/210 for International Application No. PCT/EP2013/065216 dated Aug. 22, 2013.

(Continued)

*Primary Examiner* — Edwin A. Leon

(74) *Attorney, Agent, or Firm* — Harness, Dickey & Pierce, P.L.C.

(57) ABSTRACT

A pushbutton compact component is shown, including an actuating button having a basic body, on which at least one guide projection is arranged, and a sleeve, in which a locking slide is arranged by way of a spring element. In an embodiment, the guide projection engages the locking slide such that the locking slide is positioned in the sleeve under spring pressure.

18 Claims, 2 Drawing Sheets

(52) U.S. Cl.
CPC ... *H01H 2221/044* (2013.01); *H01H 2235/004* (2013.01); *H01H 2239/03* (2013.01)

(56) References Cited

U.S. PATENT DOCUMENTS

| | | | | |
|---|---|---|---|---|
| 7,790,996 | B2 * | 9/2010 | Swamy | H01H 3/022 200/308 |
| 8,115,122 | B2 * | 2/2012 | Machida | H01H 3/022 200/16 A |
| 2009/0000935 | A1 * | 1/2009 | Calderara | H01H 13/02 200/523 |

FOREIGN PATENT DOCUMENTS

| | | | |
|---|---|---|---|
| EP | 0172926 | A1 | 3/1986 |
| WO | WO-0169619 | A1 | 9/2001 |

OTHER PUBLICATIONS

Written Opinion of the International Searching Authority PCT/ISA/237 for International Application No. PCT/EP2013/065216 dated Aug. 22, 2013.

Chinese Office Action and English translation thereof dated Apr. 5, 2016.

* cited by examiner

PUSHBUTTON COMPACT COMPONENT

PRIORITY STATEMENT

This application is the national phase under 35 U.S.C. §371 of PCT International Application No. PCT/EP2013/065216 which has an International filing date of Jul. 18, 2013, which designated the United States of America, and which claims priority to European patent application EP 12186105.8 filed Sep. 26, 2012, the entire contents of each of which are hereby incorporated herein by reference.

FIELD

At least one embodiment of invention generally relates to a pushbutton compact component including an actuating head with a main body on which at least one guide projection is arranged, and including a sleeve in which a locking slide is arranged over a spring element.

BACKGROUND

Pushbuttons of this kind are generally used to input commands to so-called machine/man interfaces. It is feasible to use the pushbuttons not only to switch control currents but also to switch power by the pushbutton being used as a trigger for circuit breakers. These pushbuttons are subject to high demands in respect of service life, robustness, sealing off the electrical part from water and dirt and also the ability to be produced in as cost-effective a manner and with as reliable a process as possible.

Command devices are fitted in switch panels, control panels, switchgear cabinet doors or housing covers. Command devices are generally of modular construction. This means that they comprise an actuator, a fastening part such as an annular nut or a mounting holder for example, and one or more switching elements which are designed as break-contact or make-contact switching elements. For assembly purposes, the actuator is generally guided, from the front, through a hole in the switch panel and fitted from the rear by means of a fastening part. The switching elements are mechanically fastened to the actuator or to the fastening part by screws, snap-action hooks or bolts. The switching elements are electrically connected to the control system by means of connection terminals.

In safety applications such as, for example, emergency-off command devices, it is stipulated that the signal be generated by virtue of positive-opening contacts being opened. This means that, if an emergency-off command device has not been actuated, the contacts, and thus the associated electrical circuit, are closed. In the event of disruption or an emergency, the break contact is broken as a result of the emergency-off actuator, which is located in front of the switch panel, being struck, and the system or machine is put into a safe state. However, this works only when the spatial arrangement of the actuator and switching element is ensured. Defective assembly or the exertion of force may result in the switching elements being mechanically separated from the actuator. In this case, the emergency-off command device is no longer functional, that is to say, upon actuation in the event of an emergency, the contacts are not opened, and therefore the hazard state cannot be eliminated. This may have fatal consequences for man and machine. A considerable amount of importance is therefore given to the reliable connection between the actuator and switching element.

In particular, the actuators have to meet complex requirements. They should, for example, be easy to fit and be as attractive as possible to the customer. The principle for each actuator is that it forwards defined switching position information and maintains the switching position. In the case of the emergency-stopping command device product group, it is particularly important to maintain the switching position so that the safety circuit is prevented from switching on again. In order to ensure this function, it is necessary to fit the locking mechanism securely in the collar.

Different structural and assembly-related solutions have been used in order to ensure functioning. For example, in specific actuators, for example emergency-stopping actuators, the functional components are individually supplied and checked, and the entire assembly is tested after assembly. Other variants hold the individual pre-fitted assemblies in position by means of fitting apparatuses, as a result of which it is subsequently necessary to test the functioning and check individual components.

SUMMARY

Accordingly, at least one embodiment of the present invention is directed to a pushbutton in the form of a functional unit which can be easily tested and further processed.

A pushbutton compact component is disclosed. Advantageous designs and developments, which can be used individually or in combination with one another, are the subject matter of the dependent claims.

According to at least one embodiment of the invention, a pushbutton compact component includes an actuating head with a main body on which at least one guide projection is arranged, and includes a sleeve in which a locking slide is arranged over a spring element. In this case, at least one embodiment of the invention is distinguished in that the guide projection engages into the locking slide in such a way that the locking slide is positioned in the sleeve under spring pressure.

BRIEF DESCRIPTION OF THE DRAWINGS

Further advantages and embodiments of the invention will be explained below with reference to an example embodiment and also with reference to the drawing, in which.

DETAILED DESCRIPTION OF THE EXAMPLE EMBODIMENTS

Figure 1:
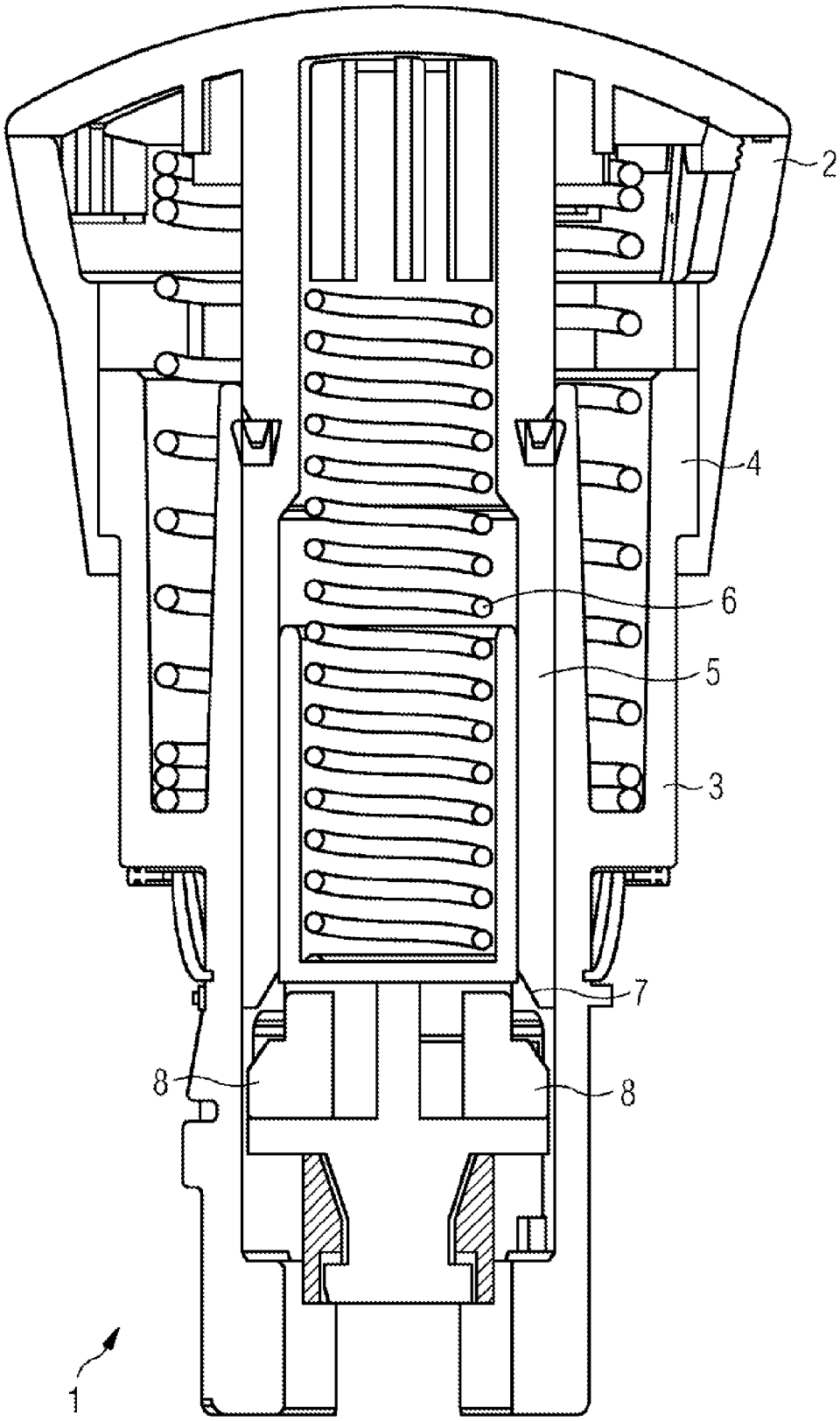
FIG. 1 schematically shows a schematic illustration of a pushbutton according to an embodiment of the invention with locking slides.

According to at least one embodiment of the invention, a pushbutton compact component includes an actuating head with a main body on which at least one guide projection is arranged, and includes a sleeve in which a locking slide is arranged over a spring element. In this case, at least one embodiment of the invention is distinguished in that the guide projection engages into the locking slide in such a way that the locking slide is positioned in the sleeve under spring pressure.

A feature of at least one embodiment of the invention is that the pushbutton compact component, in particular the mushroom-cap assembly, is structurally designed such that it can be further processed in a fixed functional assembly comprising mushroom cap, tamper spring, seal, slide sleeve, slide and slide spring directly or only later, without additionally securing the components. The fixed or moving connection between the assembly components can be ensured, for example, by welding, snap-action connection or another connection technique.

At least one embodiment of the invention includes the technical combination of the individual components to form a fixed assembly which can be further processed in a flexible manner. This results in the advantage that the pre-fitted assembly can be tested at any time and further processed as a compact unit. Additional testing of the functioning or checking of individual components thereafter can be dispensed with since the assembly is secured in a captive manner. This results, overall, in significant advantages in respect of the assembly time required for producing components, and the flexibility of the assembly concepts, that is to say manually operated, partially automated or fully automated production, is also considerably increased. Therefore, start-up and run-up can also be automated in a manner optimized for the number of units.

In a particularly advantageous embodiment, provision can be made for two guide projections to be arranged on the main body, the guide projections being operatively connected to two locking slides in the sleeve. The emergency-off devices usually have a very limited installation space available for a locking/unlocking system. It is therefore difficult to develop a system which, in respect of the service life, withstands the required actuating unlocking forces and at the same time remains functional. The main problem is the material wear on the working surfaces of the moving parts and the secure latching into the latching position.

In slide/bolt switching systems according to at least one embodiment of the invention, two slides with their own springs are installed parallel to one another in one plane, wherein they can both contribute to locking or unlocking at the same time. The slides themselves and the installation parts can be composed of different materials and be of different design, for example transparent with a cutout for a light channel.

When positioning two slides parallel to one another in one plane, the two slides can latch in the emergency-off state with double the security. This means that, when a slide is subject to material fracture, for example spring fracture or material wear, the second slide can still fully lock the system. During actuation or unlocking, the forces are distributed between two slides, this being associated with an advantage when actuation is tripped with a very high expenditure of force.

During actuation or unlocking, the forces are symmetrical, that is to say uniformly distributed and do not act on one side, this being associated with a greater degree of wear.

Slides which run parallel to one another allow a relatively large slide be installed, this having a favorable effect on the stability of the system. In addition, a relatively high latching force is possible.

The use of two slides which are installed parallel to one another in one plane has the advantage that two independent springs can be installed, said springs functioning separately from one another. This provides double the security in the event of a spring fracture. It is also advantageous for there to be a reduction in the overall size of the command and alert device.

According to at least one embodiment of the invention, provision can further be made for the locking slides to be arranged opposite one another in the sleeve.

According to at least one embodiment of the invention, provision can also be made for the locking slides to be designed to lock and/or unlock at the same time. Slides which run parallel to one another allow a relatively large slide to be installed, this having a favorable effect on the stability of the system. In addition, a relatively high latching force is possible. The use of two slides which are installed parallel to one another in one plane has the advantage that two independent springs can be installed, said springs functioning separately from one another. This provides double the security in the event of a spring fracture. It is also advantageous for there to be a reduction in the overall size of the command device.

In a particularly advantageous embodiment, provision can be made for the pushbutton compact component to be assembled on an automated production line. This results because it is possible to further process the technical combination of the individual components to form a fixed assembly, in particular to form the compact component, in a flexible manner. This results in the advantage that the pre-fitted assembly can be tested at any time and can be further processed as a compact unit.

Additional testing of the functioning or subsequent checking of individual components can be dispensed with since the assembly is secured in a captive manner. This results in significant advantages in respect of the assembly time required for producing components, and the flexibility of the assembly concepts, that is to say manually operated, partially automated or fully automated production here, is also considerably increased. Therefore, start-up and run-up can also be automated in a manner optimized for the number of units.

According to at least one embodiment of the invention, provision can also be made for the assembled pushbutton compact component comprising the actuating head with the main body, the spring element, the sleeve with at least one spring-loaded locking slide to be inserted in a further spring element and an external housing. In this case, in at least one embodiment of the invention, the guide projections on the main body of the actuating head position the spring-loaded slides fixedly in the sleeve, without there being a risk of the locking slides or the spring elements becoming loose and moving freely in the pushbutton. The guide projections on the main body of the actuating head lead to it being possible for the actuating head with the main body, the spring element, the sleeve with at least one spring-loaded locking slide to be produced as a compact component.

Furthermore, provision can also be made for the pushbutton compact component with an external housing to be inserted into an apron. Owing to the compact design of the pushbutton compact component, the further production steps are advantageously combined, as a result of which the assembly time can be shortened overall.

The pushbutton according to at least one embodiment of the invention preferably has a two-part housing comprising an actuating head and an external housing. The actuating head is preferably designed in the manner of a mushroom and overlaps the external housing, wherein the external housing is fastened to the actuating head by way of clamping elements.

Housing guides project from the actuating head into the external housing. The housing guides surround a spring element. The housing guides preferably have, at the end, insertion slopes which are operatively connected to preferably two locking slides by way of actuation of the actuating head.

The locking slides are preferably arranged opposite and parallel to one another in one plane. When the actuating head is actuated, preferably both locking slides change over to the blocking position at the same time, that is to say conversely that the two locking slides likewise have the same position in the non-actuated state.

The pushbutton compact component according to at least one embodiment of the invention comprises the actuating head which has a main body on which at least one guide projection is arranged. The pushbutton compact component also comprises the spring element which is mounted in the main body of the actuating head.

The spring element can preferably be in the form of a tamper spring. The spring element is also mounted in a sleeve in which at least one locking slide, including the spring element, is arranged. According to at least one embodiment of the invention, provision is now made for the guide projection on the main body of the actuating head to hold the spring-loaded locking slide in its position in the sleeve by the spring-loaded locking slide being mounted on the guide projection.

The pushbutton compact component according to at least one embodiment of the invention therefore comprises the actuating head which has a main body with at least one guide projection, a spring element which is mounted in the main body and there in the inner sleeve, and the sleeve in which at least one spring-loaded locking slide is arranged.

In addition, a seal can also further be provided on the actuating head. The pushbutton compact component is then mounted in a further spring element and inserted into the external housing, in particular a collar. The external housing can then be held by an apron, a front-plate seal and a pressure element.

The pushbutton compact component according to at least one embodiment of the invention is distinguished in that flexible further processing is possible on account of the technical combination of the individual components to form a fixed assembly. This results in the advantage that the pre-fitted assembly can be tested at any time and further processed as a compact unit. Additional testing of the functioning or checking of individual components thereafter can be dispensed with since the assembly is secured in a captive manner. This results in significant advantages in respect of the assembly time required for producing components, and also the flexibility of the assembly time in respect of the manually operated, partially automated or fully automated production is also considerably improved. Therefore, start-up and run-up can also be automated in a manner optimized for the number of units.

FIG. 1 shows a pushbutton 1 according to an embodiment of the invention with a preferably two-part housing comprising an actuating head 2 and an external housing 3. The actuating head 2 is preferably designed in the manner of a mushroom and overlaps the external housing 3, wherein the external housing 3 is fastened to the actuating head 2 by means of clamping elements 4. The housing guides 5 project from the actuating head 2 into the external housing 3. The housing guides 5 surround a spring element 6. The housing guides 5 have, at the end, insertion slopes 7 which are operatively connected to preferably two locking slides 8 when the actuating head 2 is actuated. The locking slides 8 are preferably arranged opposite and parallel to one another in one plane. When the actuating head 2 is actuated, both locking slides 8 change over to the locking position at the same time, that is to say conversely that both locking slides likewise have the same position in the non-actuated state.

Figure 2:
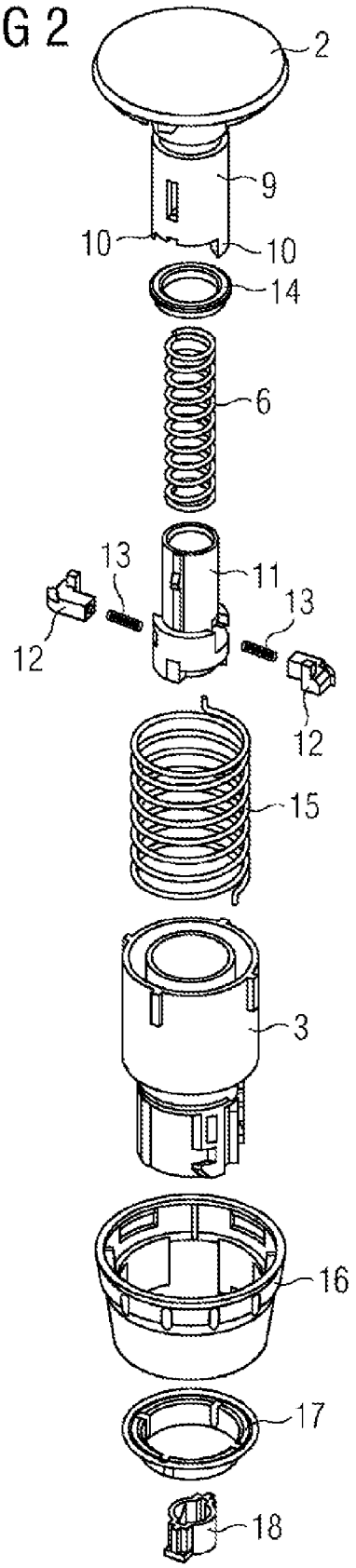
FIG. 2 schematically shows an exploded illustration of the pushbutton according to FIG. 1.

FIG. 2 shows the pushbutton compact component according to an embodiment of the invention which comprises the actuating head 2 which has a main body 9 on which at least one guide projection 10 is arranged. The pushbutton compact component also comprises the spring element 6 which is mounted in the main body 9 of the actuating head 2. The spring element 6 can preferably be in the form of a tamper spring. The spring element 6 is also mounted in a sleeve 11 in which at least one locking slide 12, including the spring element 13, is arranged. According to an embodiment of the invention, provision is now made for the guide projection 10 on the main body 9 of the actuating head 2 to hold the spring-loaded locking slide 12 in its position in the sleeve 11 by the spring-loaded locking slide 12 being mounted on the guide projection 10.

The pushbutton compact component according to an embodiment of the invention is therefore produced from the actuating head 2 which has a main body 9 and at least one guide projection 10, a spring element 6 which is mounted in the main body 9 and there in the sleeve 11, and the sleeve 11 in which at least one spring-loaded locking slide 12 is arranged. In addition, a seal 14 can also further be provided on the actuating head 2. The pushbutton compact component is then mounted in a further spring element 15 and inserted into the external housing 3, in particular a collar. The external housing 3 can then be held by the apron 16, a front-plate seal 17 and a pressure element 18.

The pushbutton compact component according to an embodiment of the invention is distinguished in that flexible further processing is possible on account of the technical combination of the individual components to form a fixed assembly. This results in the advantage that the pre-fitted assembly can be tested at any time and further processed as a compact unit. Additional testing of the functioning or checking of individual components thereafter can be dispensed with since the assembly is secured in a captive manner. This results in significant advantages in respect of the assembly time required for producing components, and also the flexibility of the assembly time in respect of the manually operated, partially automated or fully automated production is also considerably improved. Therefore, start-up and run-up can also be automated in a manner optimized for the number of units.

The invention claimed is:

1. A pushbutton compact component comprising:

an actuating head including a main body, on which at least one guide projection is arranged, and including a sleeve, in which at least one locking slide is arranged with a spring element, the at least one guide projection being configured to engage and hold the locking slide inside the sleeve under spring pressure and thereby spring-load the locking slide, the spring-loaded locking slide being positioned on the at least one guide projection.

2. The pushbutton compact component of claim 1, wherein the at least one guide projection includes two guide projections, arranged on the main body, and wherein the at least one locking slide includes two locking slides, said two guide projections being respectively operatively connected to the two locking slides in the sleeve.

3. The pushbutton compact component of claim 2, wherein the two locking slides are arranged opposite one another in the sleeve.

4. The pushbutton compact component of claim 2, wherein the two locking slides are designed for simultaneous locking.

5. The pushbutton compact component of claim 2, wherein the two locking slides are designed for simultaneous unlocking.

6. The pushbutton compact component of claim 1, wherein the pushbutton compact component is assembleable in an automated production line.

7. The pushbutton compact component of claim 1, wherein an assembled pushbutton compact component includes the actuating head including the main body, the spring element, the sleeve with at least one spring-loaded locking slide being insertable in a further spring element, and an external housing.

8. The pushbutton compact component of claim 7, wherein the pushbutton compact component with the external housing is insertable into an apron.

9. The pushbutton compact component of claim 3, wherein the two locking slides are designed for simultaneous unlocking.

10. The pushbutton compact component of claim 3, wherein the two locking slides are designed for simultaneous locking.

11. The pushbutton compact component of claim 2, wherein the two locking slides are designed for simultaneous unlocking.

12. The pushbutton compact component of claim 2, wherein the pushbutton compact component is assembleable in an automated production line.

13. The pushbutton compact component of claim 3, wherein the two locking slides are designed for simultaneous unlocking.

14. The pushbutton compact component of claim 4, wherein the two locking slides are designed for simultaneous unlocking.

15. The pushbutton compact component of claim 10, wherein the two locking slides are designed for simultaneous unlocking.

16. The pushbutton compact component of claim 2, wherein an assembled pushbutton compact component includes the actuating head including the main body, the spring element, the sleeve with at least one of the two spring-loaded locking slides being insertable in a further spring element, and an external housing.

17. The pushbutton compact component of claim 3, wherein an assembled pushbutton compact component includes the actuating head including the main body, the spring element, the sleeve with at least one of the two spring-loaded locking slides being insertable in a further spring element, and an external housing.

18. The pushbutton compact component of claim 15, wherein an assembled pushbutton compact component includes the actuating head including the main body, the spring element, the sleeve with at least one of the two spring-loaded locking slides being insertable in a further spring element, and an external housing.

* * * * *